United States Patent [19]

Berghahn

[11] 4,189,066

[45] Feb. 19, 1980

[54] DISPENSER FOR DISPENSING LIMITED AMOUNTS OF MATERIALS

[75] Inventor: Walter G. Berghahn, Scotch Plains, N.J.

[73] Assignee: Bristol-Myers Company, New York, N.Y.

[21] Appl. No.: 966,413

[22] Filed: Dec. 4, 1978

[51] Int. Cl.[2] ..... G01F 11/10

[52] U.S. Cl. ..... 222/48; 222/153; 222/368; 221/266; 401/216

[58] Field of Search ..... 222/363, 48, 153, 368, 222/536, 533, 534; 221/266; 401/216, 209; 215/312

[56] References Cited

U.S. PATENT DOCUMENTS

| | | | |
|---|---|---|---|
| 3,276,636 | 10/1966 | Johnson | 221/266 X |
| 3,312,377 | 4/1967 | Chuhran | 222/363 |
| 3,782,608 | 1/1974 | Schneider | 221/266 X |

FOREIGN PATENT DOCUMENTS

| | | | |
|---|---|---|---|
| 1114454 | 12/1955 | France | 401/216 |
| 405901 | 2/1934 | United Kingdom | 222/368 |

*Primary Examiner*—David A. Scherbel
*Assistant Examiner*—Frederick R. Handren
*Attorney, Agent, or Firm*—Irving Holtzman; George A. Mentis; David J. Mugford

[57] ABSTRACT

A container provided with a dispensing closure comprising a cavity-containing ball rotatable in the neck of the container, a resilient retaining ring holding the ball in contact with the neck, and a locking ring thereover threadable on the neck.

10 Claims, 5 Drawing Figures

DISPENSER FOR DISPENSING LIMITED AMOUNTS OF MATERIALS

This invention relates to a device for dispensing limited amounts of material such as pills, tablets, particulate substances and the like, from a container therefor, and especially to a container provided with a closure comprising a rotatable ball dispenser.

Containers provided with rotatable ball dispensers are known in the prior art. For example, U.S. Pat. No. 3,782,608 discloses such a device in which the dispensing ball rotates entirely within a specially formed housing which in turn attaches to the neck of a container. A critical feature of the patented device is the provision of protrusions on the housing which project beyond the ball and thereby prevent accidental dispensing of the contents by rolling the ball on a surface. However, the provision of such multiple protrusions, the bulky and complicated structure of the housing, and the use of excessive amounts of resilient elastic plastic material renders the device relatively difficult and costly to manufacture. Further, the device of said patent is devoid of any means for positively preventing intentional or accidental rotation of the ball with possible consequential undesired dispensing of the contents of the container.

It is an object of this invention to provide a device which will not be subject to one or more of the above disadvantages. Another object of this invention is the provision of such a device which is relatively economical and/or simple to manufacture. Still another object of the invention is the provision of such a device provided with locking means to prevent rotation of the ball. Yet another object of this invention is the provision of such a device provided with non-removable locking means. Other objects and advantages will appear as the description proceeds.

The attainment of one or more of the above objects is achieved by this invention which includes in combination, a container with a circular opening defined by a cylindrical neck having external threads and a first bearing surface at its outer end, and a locking dispensing closure comprising (1) a ball having a diameter greater than the diameter of said circular opening but less than the outside diameter of said neck and in slidable contact on one side of its equator with said first bearing surface whereby said ball is rotatable in all directions thereon; (2) a resilient open ended cylindrical retaining ring, the inner surface of one end of which is in tight contact with the outer surface of said outer end of said neck and the other end of which is provided with an inner second bearing surface in slidable contact with said ball on the other side of its equator; and (3) an open ended cylindrical locking ring provided with internal threads at one end engaging the external threads on said neck, the other end of said locking ring having an inner third bearing surface with a diameter less than the diameter of said ball and in juxtaposition to said ball on said other side of its equator, or said third bearing surface being adapted to lock said ball against rotation when said locking ring is tightened on said external threads on said neck, said ball having a cavity therein defining a dispensing volume and having an aperture into said cavity, no transverse dimension of said aperture being greater than the diameter of said first bearing surface.

The above brief description, as well as further objects, features and advantages of the present invention, will be more fully appreciated by reference to the following detailed description of presently preferred, but nonetheless illustrative, embodiments in accordance with the present invention, when taken in conjunction with the accompanying drawings, in which.

Figure 1:
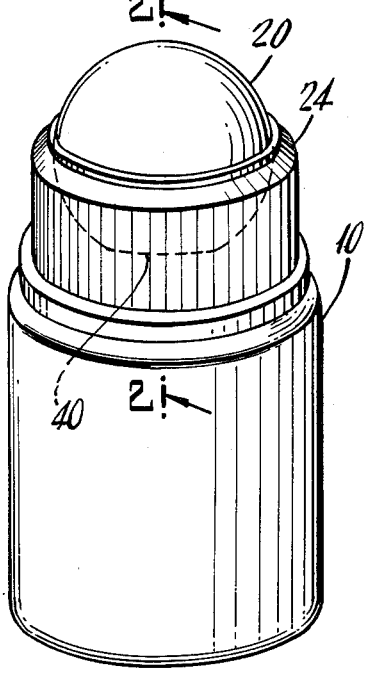
FIG. 1 is a perspective view of one embodiment of the invention.
Figure 2:
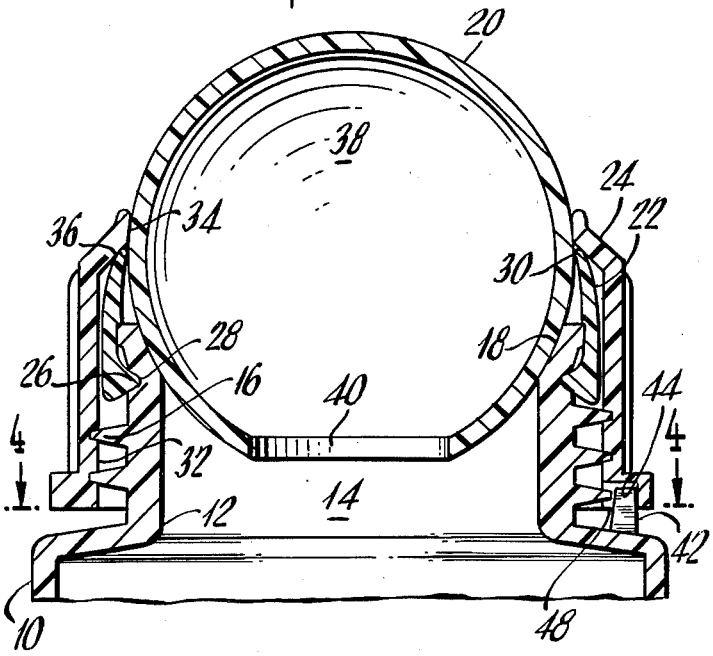
FIG. 2 is an expanded sectional view taken along the line 2—2 of FIG. 1 showing the device in the closed position.

Reference is now made to FIGS. 1 and 2 of the drawing in which one embodiment of the present invention is illustrated. Container 10 has a cylindrical neck 12 defining a circular opening 14. Neck 12 is provided with external threads 16 and, at its outer end, a first bearing surface 18. The locking dispensing closure of this invention comprises generally a ball 20, a resilient open ended cylindrical retaining ring 22, and an open ended cylindrical locking ring 24.

Ball 20 is positioned at the outer end of neck 12 in slidable contact with first bearing surface 18 whereby ball 20 is rotatable thereon in all directions. The outside diameter of ball 20 is greater than the diameter of circular opening 14 (i.e. the inside diameter of neck 12) but less than the outside diameter of neck 12 as measured across the tips of the ridges of threads 16.

Retaining ring 22 is fastened to and in tight contact with the outer end of neck 12 by means of flanges 26 on the inner surface of one end of ring 22 cooperating with grooves 28 on the outer surface of the outer end of neck 12. Resilient retaining ring 22 is provided at its other end with an inner second bearing surface 30. As seen in FIG. 2, first bearing surface 18 on neck 12 contacts ball 20 on one side of its equator and second bearing surface 30 of ring 22 contacts ball 20 on the other side of its equator whereby ball 20 is retained against and closes the outer end of neck 12.

Locking ring 24 is provided at one end with internal threads 32 engaging external threads 16 of neck 12. The other end of locking ring 24 is provided with an inner third bearing surface 34 with a diameter less than the diameter of ball 20 and in juxtaposition to ball 20 on the same side of its equator as second bearing surface 30. As shown, ball 20 is locked against rotation when the tightening of locking ring 24 on external threads 16 on neck 12 forces third bearing surface 34 against ball 20. As an alternative, retaining ring 22 may be provided with an outer fourth bearing surface 36 adjacent inner second bearing surface 30, and inner third bearing surface 34 on locking ring 24 is adapted to bear against fourth bearing surface 36. According to this alternative, ball 20 is locked against rotation when the tightening of locking ring 24 on external threads 16 on neck 12 forces third bearing surface 34 against fourth bearing surface 36, thereby forcing second bearing surface 30 against ball 20.

Ball 20 is provided with cavity 38, the volume of cavity 38 determining the maximum dispensing volume. As illustrated, ball 20 is substantially hollow whereby the maximum dispensing volume corresponds substantially to the volume of ball 20. Aperture 40 in ball 20 provides access to cavity 38. It is preferred that no transverse dimension of aperture 40 be greater than the diameter of first bearing surface 18 in order to provide improved sealing between the inside of container 10 and the atmosphere.

Figure 5:
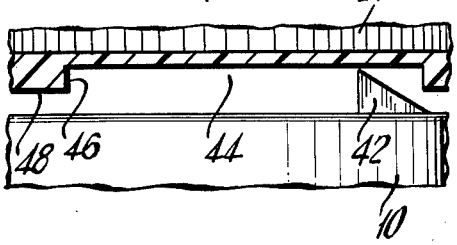
FIG. 5 is a sectional view taken along the line 5—5 of FIG. 4.
Figure 4:
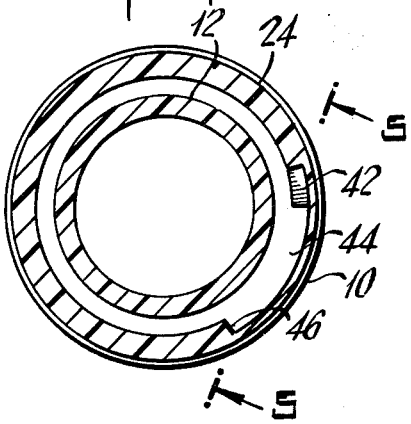
FIG. 4 is a sectional view taken along the line 4—4 of FIG. 2.

This invention provides means on locking ring 24 cooperating with adjacent means on the outer surface of container 10 for rendering locking ring 24 substantially non-removable from container 10 but still rotatable on threads 16. As best seen in FIGS. 2, 4 and 5, projection or tab 42 is provided on the shoulder of container 10. Preferably, tab 42 has one side substantially vertical while the opposite side is ramp-shaped (as shown in FIG. 5). Slot 44 is provided on the bottom edge of locking ring 24 and positioned so that tab 42 may engage slot 44 when locking ring 24 is threaded down onto threads 16. The leading edge 46 of slot 44 is preferably substantially vertical as shown.

It is intended during the assembly of the parts of this invention, after resilient retaining ring 22 has been placed in tight contact on the outer end of neck 12 and after ball 20 has been placed in position, that locking ring 24 be threaded onto thread 16 and tightened down. Slot 44 is located on locking ring 24 in such position that as ring 24 is threaded down on threads 16 (clockwise in FIG. 4) leading shoulder 48 of slot 44 bears against and "climbs" the ramp-shaped side of tab 42. As the tightening continues, leading edge 46 of slot 44 passes the vertical side of tab 42, whereupon tab 42 becomes engaged in slot 44. An attempt to remove locking ring 24 from threads 16 at this point by turning ring 24 counterclockwise will cause substantially vertical leading edge 46 of slot 44 to abut against the substantially vertical side of tab 42. It is apparent that a great deal of force would have to be applied to cause these two substantially vertical surfaces to move past each other, and thus locking ring 24 is rendered substantially non-removable from thread 16. However, further tightening (on clockwise rotation) is possible. The length of slot 44 is selected to allow locking ring 24 to be further tightened until third bearing surface 34 bears against ball 20 or fourth bearing surface 36, as the case may be, thereby locking ball 20 against rotation.

Other means for rendering locking ring 24 substantially non-removable from container 10 but still rotatable on threads 16 are intended to be included within the scope of this invention. For example, slot 44 on locking ring 24 may be replaced by a projection or a tab similar to tab 42 but with vertical and "ramp" sides reversed. Thus, in tightening locking ring 24 onto threads 16, the two ramp shaped sides would slide over each other, but once the vertical sides had passed each other, removal would be substantially prevented. As another example of means to perform the same function, cooperating slots may be provided in both locking ring 24 and container 10 with a "stop" slidable in both slots or tracks. The lengths of the slots and the size of the stop would determine the amount of rotational freedom allowed but the stop would prevent unthreading and removal.

Figure 3:
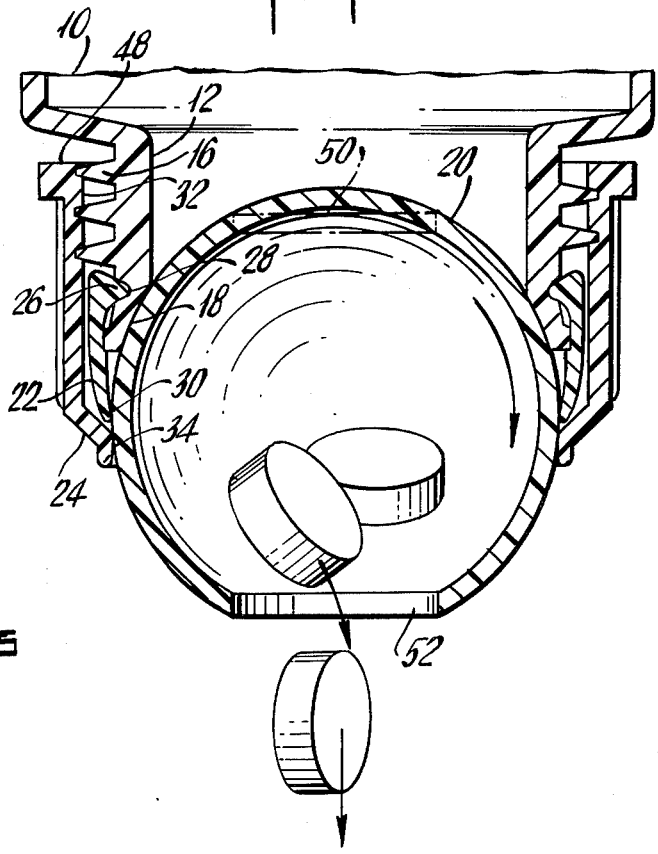
FIG. 3 is an expanded sectional view similar to FIG. 2 showing the device inverted and in dispensing position.

As noted above, the volume of cavity 38 in ball 20 determines the maximum dispensing volume of the device of this invention available with a single rotation of ball 20 (illustrated in FIG. 3). However, the volume of cavity 38 need not be substantially equal to the volume of ball 20 but may be selected to be considerably less. Ball 20 may be substantially solid and the volume of cavity 38 may be limited to the volume of a desired dispensing amount, as for example, a single dose of the contained solid, liquid, powder, etc. If the material to be dispensed is a solid pf a particular shape such as a pill, the shape of cavity 38 as well as the volume is selected to accomodate the desired dispensing amount, either a single or even multiple pills in this instance. For some purposes, it may be desired to provide multiple cavities in ball 20, and these multiple cavities may have volumes and/or shapes different from each other. The size and/or shape of aperture 40 in ball 20 is selected to cooperate with cavity 38 in determining the dispensing amount. Appropriate selection of the size and/or shape of aperture 40 may also yield further beneficial results. For example, if the size of aperture 40 is selected such that no transverse dimension thereof is greater than the shortest distance between first bearing surface 18 and second bearing surface 30 several advantages result. First, since aperture 40 cannot "overlap" both the first and second bearing surfaces simultaneously, no rotational position of ball 20 can result in direct contact between the contents of container 10 and the atmosphere. Second, when the rotational position of ball 20 is selected to place aperture 40 between first bearing surface 18 and second bearing surface 30, cavity 38 is isolated from both the interior of container 10 and the atmosphere, and the interior of container 10 is separated from the atmosphere by two complete seals. The foregoing limitation on the size of aperture 40 permits a three step dispensing sequence: first, with the container 10 inverted as shown in FIG. 3, and aperture 40 facing the interior of the container (position 50), cavity 38 is filled with material to be dispensed; second, ball 20 is rotated to position aperture 40 between first bearing surface 18 and second bearing surface 30 isolating cavity 38 and providing a "hold" position whereby container 10 may be righted and stored until dispensing is desired; and third, container 10 is reinverted and ball 20 is rotated to position aperture 40 outwardly of container 10 (position 52) whereby the contents of cavity 38 are released.

In order to facilitate use of the dispensing container of this invention, and more particularly to facilitate the three step dispensing sequence described above, ball 20 is provided with indicia means for indicating the rotational position of aperature 40 with respect to container 10 whereby the position of aperture 40 can be determined even though container 10 and/or locking ring 24 may be opaque. According to a preferred form of indicia means contemplated by this invention, the surface of ball 20 is provided with or divided into dissimilar hemispheres with aperture 40 centered in one of such hemispheres. The two hemispheres may be dissimilar in color, opacity, pattern, or any other visually distinguishing feature, but regardless of the particular distinguishing feature utilized, when only the hemisphere without aperture 40 is visible through the open top of locking ring 24, then it is known to the user that aperture 40 faces the interior of container 10 (position 50). When both hemispheres are equally exposed, it is known to the user that aperture 40 faces to the side and is in the "hold" position, and naturally position 52 is immediately obvious. This indicia means also provide information as to the proper direction of rotation in order to position ball 20 in the desired rotational position.

Another form of indicia means suitable for this invention is the provision of latitudinal and/or longitudinal lines on the surface of ball 20 with aperture 40 located at one of the "poles". The lines provide similar information to that provided by the dissimilar hemispheres. Yet another indicia means is the provision of some form of marking on ball 20 opposite to the position of aperture 40, while still another suitable indicia means is the provision of an equatorial line on ball 20 with aperture 40 located in a polar position.

This invention has been disclosed with respect to certain preferred embodiments, and it will be understood that various modifications and variations thereof which will be obvious to a worker or ordinary skill in the art are to be included within the spirit and purview of this application and the scope of the appended claims.

What is claimed is:

1. In combination, a container with a circular opening defined by a cylindrical neck having external threads and a first bearing surface at its outer end, and a locking dispensing closure comprising:

(a) a ball having a diameter greater than the diameter of said circular opening but less than the outside diameter of said neck and in slidable contact on one side of its equator with said first bearing surface whereby said ball is rotatable in all directions thereon, (b) a resilient open ended cylindrical retaining ring, the inner surface of one end of which is in tight contact with the outer surface of said outer end of said neck and the other end of which is provided with an inner second bearing surface in slidable contact with said ball on the other side of its equator, and (c) an open ended cylindrical locking ring provided with internal threads at one end engaging the external threads on said neck, the other end of said locking ring having an inner third bearing surface with a diameter less than the diameter of said ball and in juxtaposition to said ball on said other side of its equator, said third bearing surface being adapted to lock said ball against rotation when said locking ring is tightened on said external threads on said neck, said ball having a cavity therein defining a dispensing volume and having an aperture into said cavity, no transverse dimension of said aperture being greater than the diameter of said first bearing surface.

2. The combination of claim 1 wherein said ball is locked against rotation when the tightening of said locking ring on said external threads on said neck forces said third bearing surface against a fourth bearing surface on the outer surface of said other end of said resilient retaining ring, thereby forcing said second bearing surface against said ball.

3. The combination of claim 1 wherein said ball is locked against rotation when the tightening of said locking ring on said external threads on said neck forces said third bearing surface against said ball.

4. The combination of claim 1 wherein means provided at the threaded end of said locking ring cooperates with adjacent means on the outer surface of said container for rendering said locking ring substantially non-removable but still rotatable on said theads.

5. The combination of claim 4 wherein one of said means comprises a projection and the other of said means comprises a cooperating slot.

6. The combination of claim 4 wherein both said means comprise cooperating projections.

7. The combination of claim 1 wherein said tight contact between said resilient ring and said neck is obtained by the provision on said resilient retaining ring and on said neck of groove means cooperating with flange means.

8. The combination of claim 1 wherein no transverse dimension of said aperture is greater than the shortest distance between said first and said second bearing surfaces whereby at least one of said first and second bearing surfaces is in continuous uninterrupted contact with the surface of the balls, thereby ensuring a seal between the interior of the container and the atmosphere, and permitting sealing of said cavity from both the atmosphere and the interior of the container.

9. The combination of claim 1 wherein said ball is provided with indicia means for indicating the rotational position of the aperture in said ball.

10. The combination of claim 1 wherein said ball is substantially hollow whereby said dispensing volume corresponds substantially to the volume of said ball.

* * * * *